US007201438B2

(12) United States Patent
Reinsch et al.

(10) Patent No.: US 7,201,438 B2
(45) Date of Patent: Apr. 10, 2007

(54) TWO-POSITION ARM CHAIR

(75) Inventors: Peter Reinsch, Gevelsberg (DE); Martin Wolowski, Wetter (DE); Martin Kristen, Gelsenkirchen (DE)

(73) Assignee: Stanzwerk Wetter Sichelschmidt GmbH & Co. KG, Wetter (DE)

( * ) Notice: Subject to any disclaimer, the term of this patent is extended or adjusted under 35 U.S.C. 154(b) by 0 days.

(21) Appl. No.: 11/217,116

(22) Filed: Aug. 31, 2005

(65) Prior Publication Data

US 2006/0049673 A1 Mar. 9, 2006

(30) Foreign Application Priority Data

Sep. 3, 2004 (DE) ..... 20 2004 013 904 U

(51) Int. Cl.
*A47C 1/02* (2006.01)

(52) U.S. Cl. ..... 297/61

(58) Field of Classification Search ..... 297/61, 297/391

See application file for complete search history.

(56) References Cited

U.S. PATENT DOCUMENTS 4,386,803 A * 6/1983 Gilderbloom ..... 297/84
4,691,961 A * 9/1987 Rogers et al. ..... 297/61
4,830,429 A * 5/1989 Petitjean ..... 297/284.4
5,000,510 A * 3/1991 Lafer ..... 297/84
5,310,243 A * 5/1994 Pine ..... 297/61
5,340,191 A * 8/1994 May ..... 297/61
5,346,277 A * 9/1994 Holobaugh et al. ..... 297/61
5,374,100 A * 12/1994 Rogers et al. ..... 297/61
5,464,269 A * 11/1995 Mizelle ..... 297/61

* cited by examiner

*Primary Examiner*—Milton Nelson, Jr.
(74) *Attorney, Agent, or Firm*—Andrew Wilford

(57) ABSTRACT

A chair has a frame, a seat on the frame, a back on the frame, and a link between the seat and the back for shifting the seat and back between a sitting position with the back generally vertical and the seat generally horizontal and a relaxed position with the back less vertical and the seat shifted forward on the frame. A pivot defines a horizontal pivot axis carrying the headrest for pivoting between a generally horizontal position extending rearward from the pivot axis and an erect position extending upward from an upper end of the back. A linkage connected between the headrest and the back pivots the headrest about the axis into the erect position on shifting of the back and seat into the relaxed position and pivots the headrest about the axis into the horizontal position on shifting of the back and seat into the sitting position.

13 Claims, 6 Drawing Sheets

TWO-POSITION ARM CHAIR

FIELD OF THE INVENTION

The present invention relates to a chair. More particularly this invention concerns a normally upholstered arm chair that can move between a generally erect sitting position and a more stretched-out reclined position.

BACKGROUND OF THE INVENTION

A standard chair has a generally stationary frame that may have a pair of horizontally spaced arms, a seat on the frame between the arms, and a back on the frame. A link between a rear end of the seat and a lower end of the back synchronously shifts the seat and back between a sitting position with the back generally vertical and the seat generally horizontal and shifted rearward on the frame and a relaxed position with the back less vertical and the seat shifted forward on the frame. A headrest is provided on the frame above an upper end of the back and upholstery in the form of a flexible cover extends over the headrest, back, and seat.

In the standard such chair a lever on the side of the chair is operated to shift the seat and back between the sitting and relaxed positions. The headrest is fixed at the upper end of the back and moves up and down with it, as the back typically is in a lower position in the relaxed position. Thus, whatever position the headrest is in, it will follow the back.

OBJECTS OF THE INVENTION

It is therefore an object of the present invention to provide an improved two-position arm chair.

Another object is the provision of such an improved two-position arm chair that overcomes the above-given disadvantages, in particular that couples the movement of the headrest to that of the seat and back.

SUMMARY OF THE INVENTION

A chair has according to the invention a generally stationary frame, a seat on the frame, a back on the frame, and a link between a rear end of the seat and a lower end of the back for synchronous shifting of the seat and back between a sitting position with the back generally vertical and the seat generally horizontal and shifted rearward on the frame and a relaxed position with the back less vertical and the seat shifted forward on the frame. A headrest is provided on the frame above an upper end of the back, and a flexible cover extends over the headrest, back, and seat. A pivot defines a horizontal pivot axis fixed at the upper end of the back and carrying the headrest for pivoting of the headrest between a generally horizontal position extending rearward from the pivot axis and an erect position extending upward from an upper end of the back. A linkage connected between the headrest and the back pivots the headrest about the axis into the erect position on shifting of the back and seat into the relaxed position and pivots the headrest about the axis into the horizontal position on shifting of the back and seat into the sitting position.

Thus with this system when the chair is put in the relaxed position, in which the back drops somewhat and tips somewhat more rearward and the seat shifts forward and drops somewhat at the rear, the headrest automatically moves into the erect position. In the sitting position the headrest lies horizontally on the top of the back of the frame and the chair has a standard appearance.

According to the invention the back has a frame member on which the link is pivoted. In additon the headrest has a frame member secured to the pivot and connected to the linkage. Normally in accordance with the invention the frame includes a pair of bars flanking the headrest, extending generally vertically, and having upper ends forming the pivot.

The linkage according to the invention includes a main link having an upper end pivoted on the headrest at an axis parallel to but offset from the pivot axis and a lower end, a lever centrally pivoted on the frame, having one end pivoted on the lower end of the main link and an opposite end, and means connecting the opposite end of the lever to the back. This means connecting the opposite end to the back can be a pivot. The opposite end is pivoted directly on the back. Alternately, the means connecting the opposite end to the back is a rigid secondary link having one end pivoted on the opposite end and another end pivoted on the back.

In accordance with the invention the cover extends over a front face of the headrest and can form a part of the linkage. The cover tightens and pulls the headrest into the erect position on shifting of the back into relaxed position.

According to the invention the cover extends continuously over front faces of the headrest, back, and seat. In addition the frame has sides that cover and conceal the link and linkage in the sitting position.

The chair wherein the means including the link also includes an upper link having a rear end pivoted on the frame and a front end pivoted on the back, and a lower link having a rear end pivoted on the frame and a front end pivoted on the back.

The chair wherein in the horizontal position an upper surface of the headrest is directed vertically upward and extends horizontally. The upper surface forming in the erect position an extension of a front face of the back.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
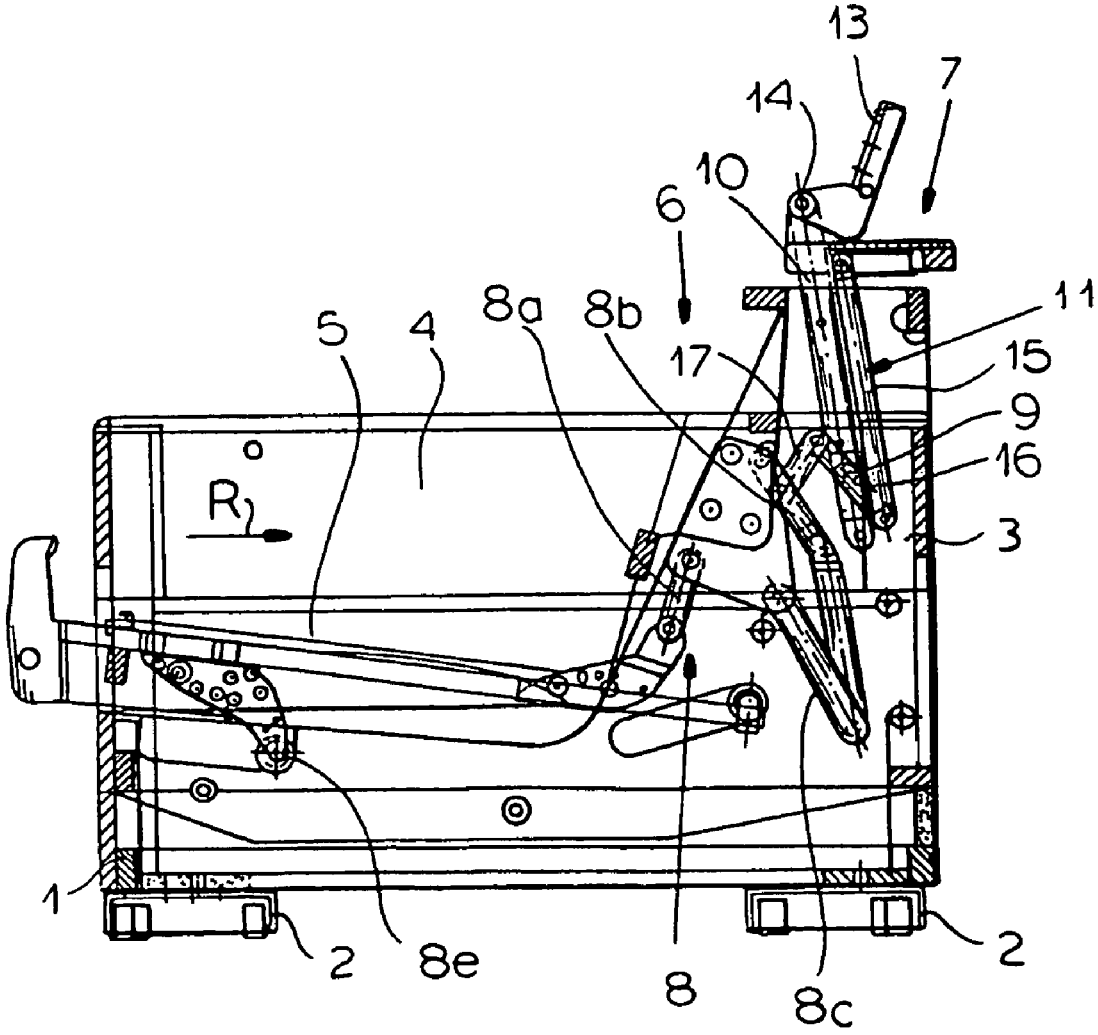
FIG. 1 is a vertical section through a chair according to the invention in the sitting position.
Figure 2:
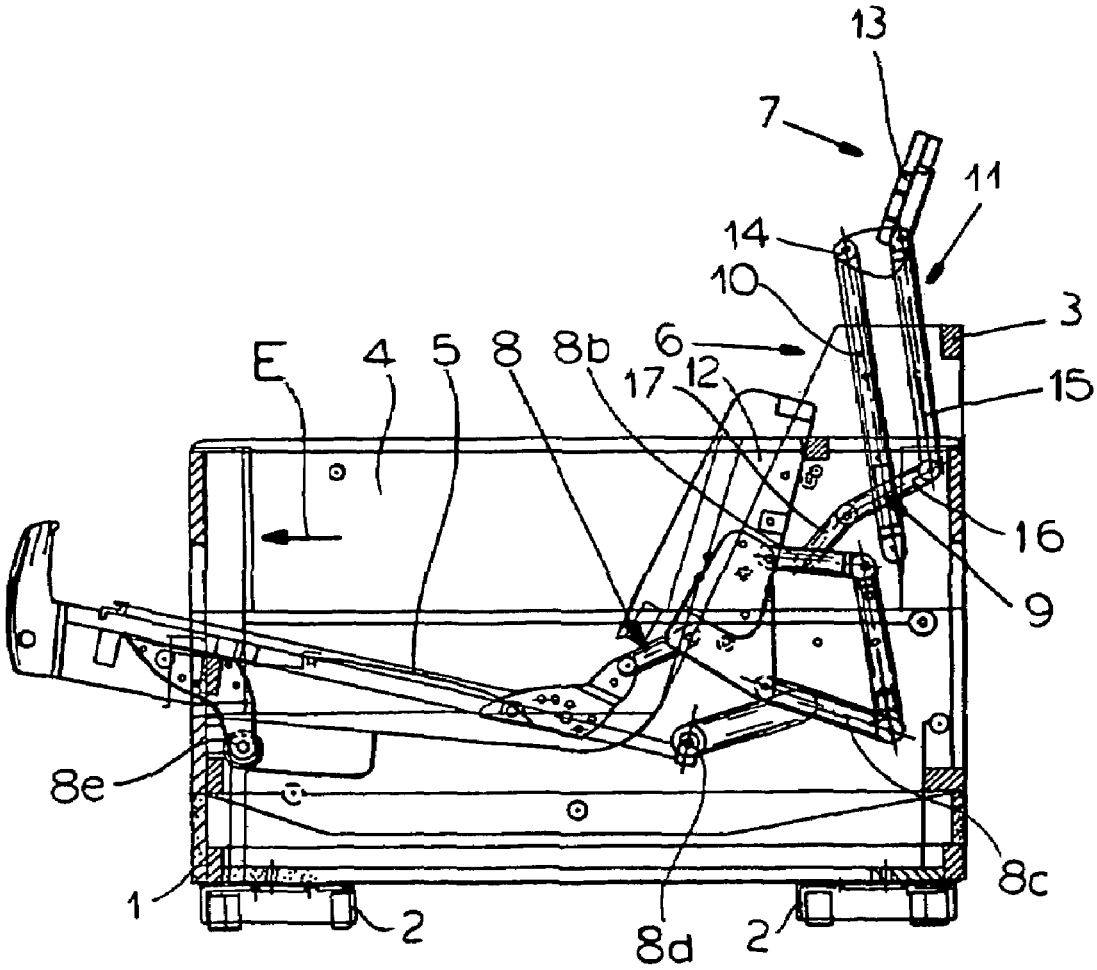
FIG. 2 is a view like FIG. 1 but showing the chair in the reclined position.

As seen in FIGS. 1 and 2 a chair according to the invention has a frame 1 that stands via feet 2 on the floor and that has back frame members 3 and a pair of horizontally spaced arms 4. The user of this chair is supported on a generally horizontal seat 5 and leans back against a generally vertical back 6, both of which are normally covered by upholstery not shown in FIGS. 1 and 2 for clarity of view but illustrated in FIGS. 3 through 10. In addition there is a headrest 7 which can move as described in more detail below between the generally horizontal down position of FIG. 1 and the generally vertical up position of FIG. 2.

A linkage 8 interconnects the seat 5 and back 6 and supports them on the frame 1 for movement between the sitting position of FIG. 1 and the reclined position of FIG. 2. In the FIG. 1 sitting position the back 6 is in an upper position and the seat 5 is pulled back into the frame in a retraction direction R into a rearmost position. In the FIG. 2 reclined position the back 6 is moved down into a lower position and the seat 5 is moved outward in a forward direction E so that it projects forward well past the frame 1. As the back 6 moves from the upper position to the lower position it forms a slightly larger angle with the vertical, that is it leans back somewhat. Similarly as the seat 5 moves from the sitting to the reclining position, it forms a slightly larger angle with the horizontal, that is it tips downward and back somewhat more steeply.

To this end the linkage 8 comprises a pair of identical assemblies flanking the seat 5 and back 6 and each comprising links 8*a*, 8*b*, and 8*c* and roller units 8*d* and 8*e*. Each link 8*a* has a lower end pivoted at a rear end of the seat 5 and an upper end pivoted on the lower end of a side frame member 12 of the back 6, about parallel horizontal axes. The links 8*b* and 8*c* have front ends pivoted one above the other on the frame member 12 of back 6 and rear ends pivoted one above the other on the frame 3 so as to form a quasi parallelogrammatic linkage, once again with all pivot axes parallel and horizontal. The roller assemblies 8*d* and 8*e* allow the seat 5 to move generally horizontally forward and slightly upward in the extension direction E and rearward and slightly downward in the retraction direction R between the sitting and reclined positions.

According to the invention the headrest 7 is moved between its positions by another linkage 11 comprising two identical sets of links 15 and 17 and levers 16. The lower end of a frame member 13 of the headrest 7 is secured at a pivot axis 14 defined by the upper end of a pair of support bars 10 fixed to the frame 3, so that this headrest 7 can pivot about the axis 14 but cannot move radially or axially of it. The lever 15 has an upper end pivoted on the frame member 13 of the headrest 7 offset from the axis 14 and a lower end on the rear end of the lever 16 which operates as a first-class lever pivoted centrally at a fixed axis 9 below the axis 14 on the bar 10 and having a front end pivoted at the top end of the link 17 which has a lower end pivoted centrally on the link 8*b*. Thus the link 15, bar 10, rear end of the lever 16, and seat back 6 form another quasi parallelogrammatic linkage that pivots the headrest 7 up into the erect position shown in fine lines in FIG. 1 and in thick lines in FIGS. 1 and 2 when the seat 5 and back 6 are in the reclined position of FIG. 2 and pivots it down into the horizontal position shown in thick lines in FIG. 1 when the seat 5 and back 6 are in the sitting position. In the down position the headrest overlies the back members 3 of the frame 1 and in the up position it forms a vertical extension of the back 6.

With this system therefore if the user moves the chair, typically by actuating a lever on the right side, into the reclined position, the headrest 7 will automatically erect itself and be available for the user, who presumably is going to lean back. In the FIG. 1 sitting position the headrest is not deployed but instead lies flat on the rear of the chair so it presents a completely standard appearance.

Figure 3:
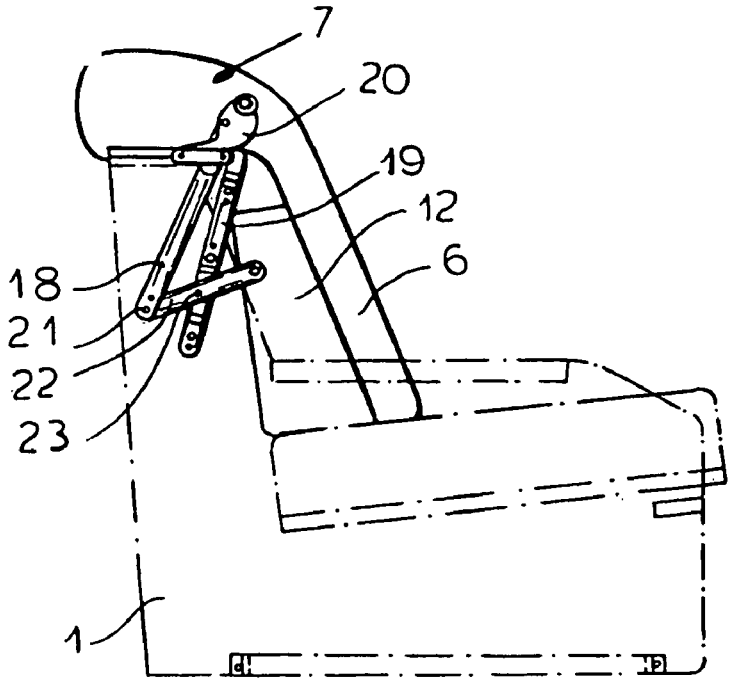
FIGS. 3 and 4 are largely schematic side views of a second chair according to the invention in the sitting and reclined positions.
Figure 4:
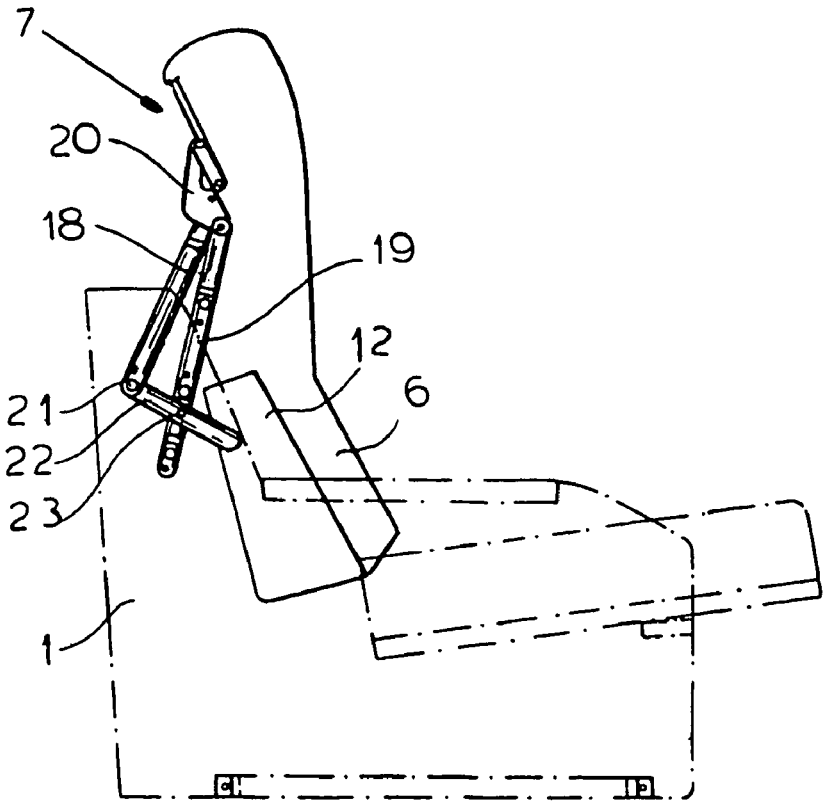

The arrangement of FIGS. 3 and 4 is similar to that of FIGS. 1 and 2. Here the headrest 7 has a frame member 20 that is pivoted at the upper end of a pair of fixed mounting bars 19 so that, once again, it can only pivot on the frame 1 but does not move radially or axially of its pivot axis. A pair of links 18 have upper ends pivoted on the member 20 offset from the respective bars 19 and lower ends each pivoted at 21 on a respective two-arm lever 22 centrally pivoted at 23 on the respective bar 19 and pivoted at its front end directly on the member 12 of the seat back 6. Thus this system basically lacks the link 17.

Figure 5:
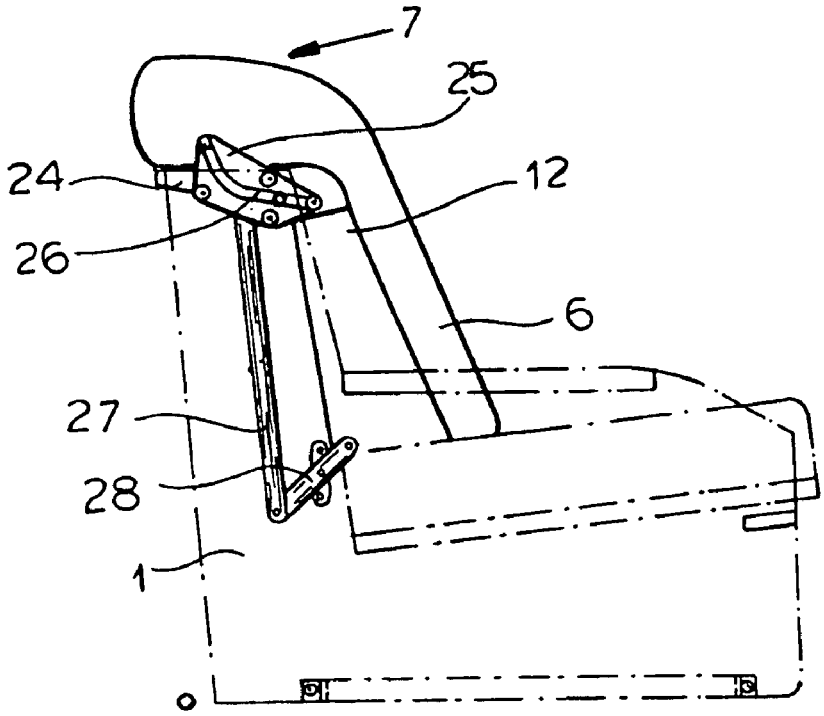
FIGS. 5 and 6 are largely schematic side views of a third chair according to the invention in the sitting and reclined positions.
Figure 6:
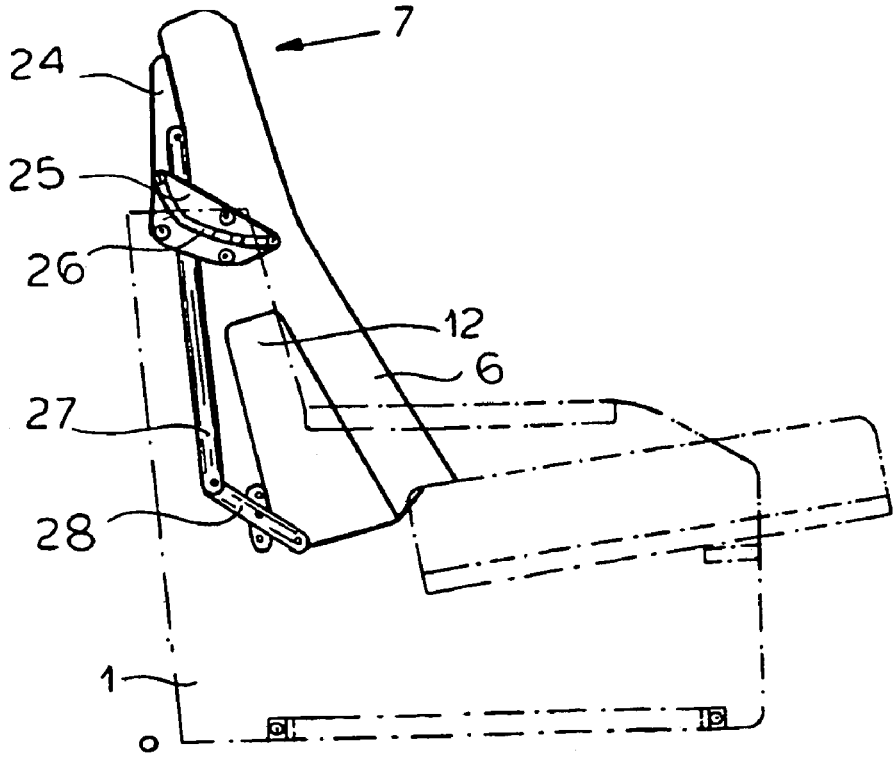

FIGS. 5 and 6 show a system where the headrest 7 has a pair of frame parts 24 with bolts that ride in slots 26 of plates 25 fixed on the frame 1. Here a link 27 functioning like the line 15 and a lever 28 functioning like the lever 16, but coupled directly to the back frame member 12 move the headrest between the horizontal down position of FIG. 5 to the erect upper position of FIG. 6.

Figure 7:
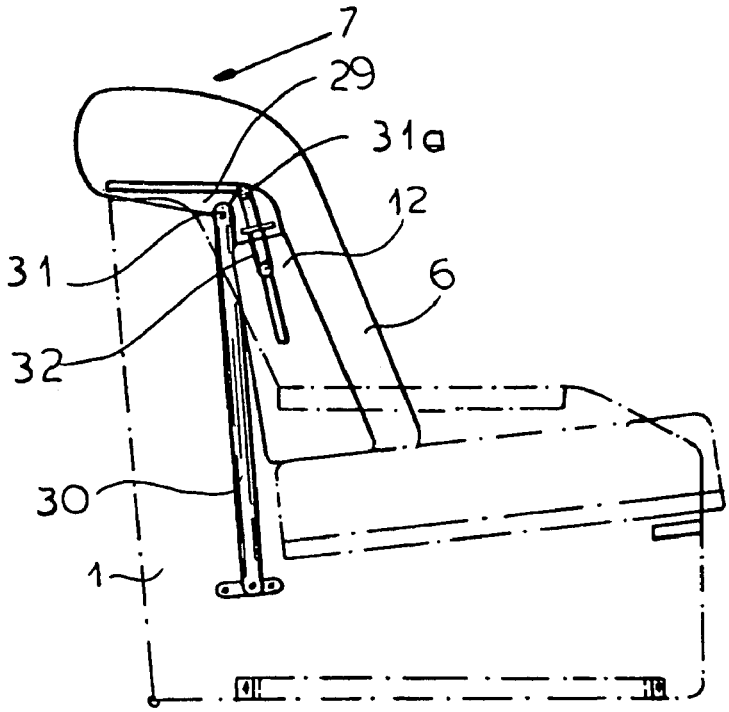
FIGS. 7 and 8 are largely schematic side views of a fourth chair according to the invention in the sitting and reclined positions.
Figure 8:
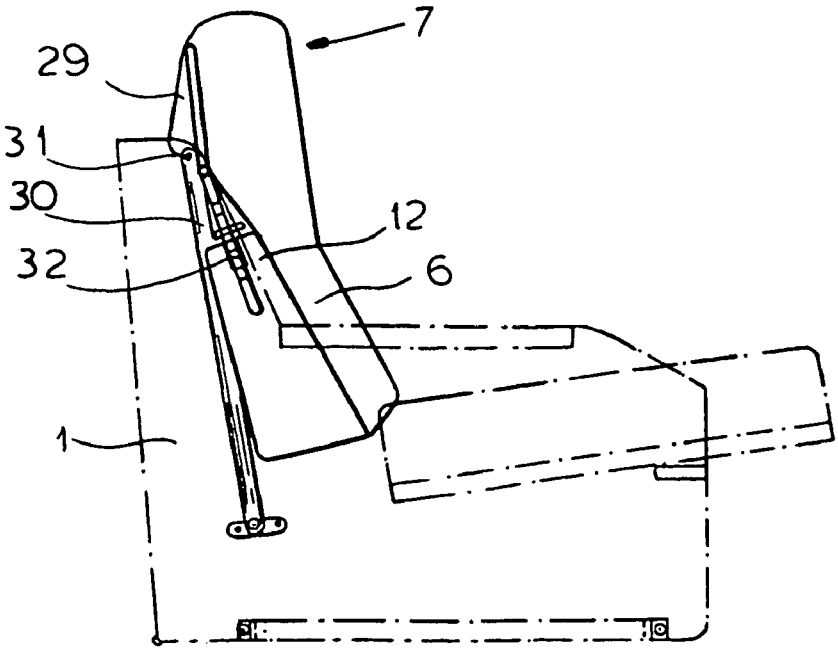

In FIGS. 7 and 8 the headrest 7 has a frame formed by a plate 29 on which is pivoted at 31 the upper ends of links 30 pivoted on the frame 1. Another link bar 32 is pivoted at 31*a* on the plate 29 offset from the axis 31 and the lower end of the link 32 is pivoted on the seat back 6, so when it drops into the reclined position, the headrest 7 is erected.

Figure 9:
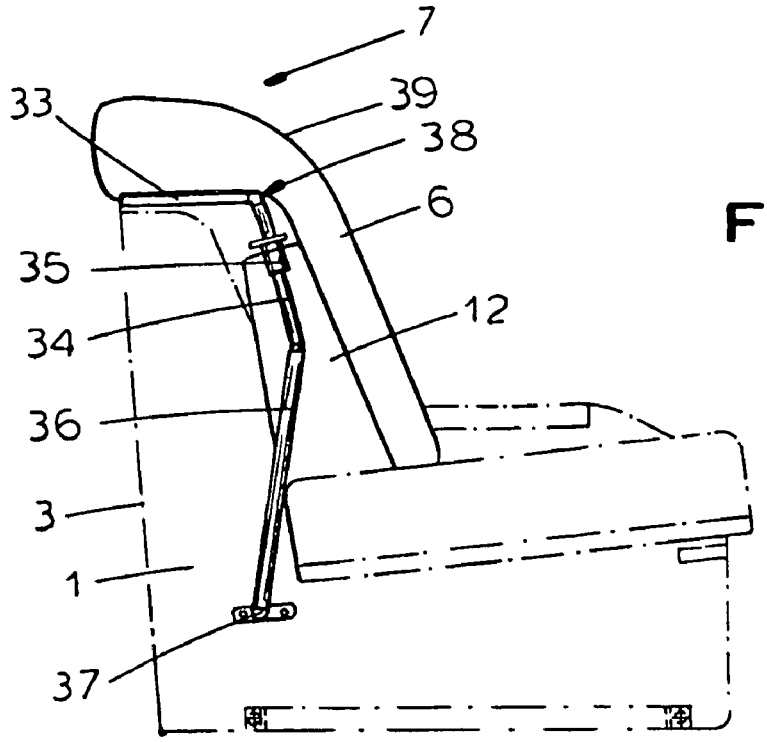
FIGS. 9 and 10 are largely schematic side views of a fifth chair according to the invention in the sitting and reclined positions.
Figure 10:
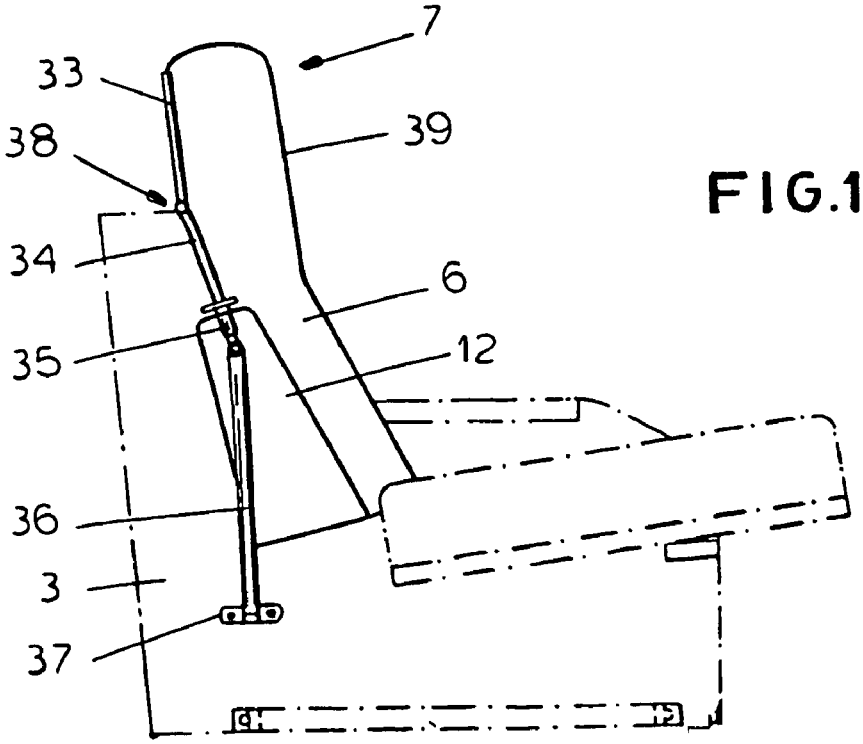

The arrangement of FIGS. 9 and 10 is particularly simple and inexpensive to manufacture. As in FIGS. 9 and 10, the headrest 7 has on its back a frame bar 33 that could also be a plate. One end of the bar 33 is pivoted at 38 to a guide rod 34. A guide sleeve 35 slidable along the rod 34 is fixed to the back frame member 12. The other end of the guide rod 34 is pivoted on a first end of a vertically extending fitting 36. The second end 37 of the fitting 36 is pivoted on the frame 1. This way the cover or upholstery 39 of the seat forms a hinge and is connected at 38 to the rear side of the headrest 7 and serves in fact to operate it.

When the back 6 that is attached to the cover 29 is moved downward on shifting of the chair into the reclined position, the cover 39 pulls down on the front edge of the seat back, offset from the pivot 38, to swing it up into the FIG. 10 erect position.

In all the embodiments, the headrest 7 does not move vertically with the back 6. Instead it follows a rocking or pivoting movement between a horizontal position effectively recessed in or forming the top of the rear of the chair, and an upright position forming a vertical continuation of the seat back 6. On the other hand, the back 6 and seat 5 are coupled together and always move jointly and synchronously. In any position, the upholstery 39 tight over the headrest 7, back 6, and seat 5 and does not wrinkle at the joints.

We claim:

1. A chair comprising:

a generally stationary frame;

a seat on the frame having a frame member;

a back on the frame;

means including a link pivoted on the frame member between a rear end of the seat and a lower end of the back for synchronous shifting of the seat and back between a sitting position with the back generally vertical and the seat generally horizontal and shifted rearward on the frame and a relaxed position with the back less vertical and the seat shifted forward on the frame;

a headrest on the frame above an upper end of the back;

a flexible cover over the headrest, back, and seat;

a pivot defining a horizontal pivot axis fixed at the upper end of the back and carrying the headrest for pivoting the headrest between a generally horizontal position extending rearward from the pivot axis and an erect position extending upward from an upper end of the back; and means including a main link having an upper end pivoted on the headrest at an axis parallel to but offset from the pivot axis and a lower end;

a lever centrally pivoted on the frame, having one end pivoted on the lower end of the main link and an opposite end; and a rigid secondary link having one end pivoted on the opposite end and another end pivoted on the back for pivoting the headrest about the axis into the erect position on shifting of the back and seat into the relaxed position and for pivoting the headrest about the axis into the horizontal position on shifting of the back and seat into the sitting position.

2. The chair defined in claim 1 wherein the back has a frame member on which the link is pivoted.

3. The chair defined in claim 1 wherein the headrest has a frame member secured to the pivot and connected to the linkage.

4. The chair defined in claim 1 wherein the frame includes a pair of bars flanking the headrest, extending generally vertically, and having upper ends forming the pivot.

5. The chair defined in claim 1 wherein the cover extends continuously over front faces of the headrest, back, and seat.

6. The chair defined in claim 1 wherein in the horizontal position a surface of the headrest is directed vertically upward and extends horizontally, the upper surface forming in the erect position an extension of a front face of the back.

7. A chair comprising:

a generally stationary frame;

a seat on the frame having a frame member;

a back on the frame;

means including a link pivoted on the frame member between a rear end of the seat and a lower end of the back for synchronous shifting of the seat and back between a sitting position with the back generally vertical and the seat generally horizontal and shifted rearward on the frame and a relaxed position with the back less vertical and the seat shifted forward on the frame;

a headrest on the frame above an upper end of the back;

a flexible cover over the headrest, back, and seat;

a pivot defining a horizontal pivot axis fixed at the upper end of the back and carrying the headrest for pivoting the headrest between a generally horizontal position extending rearward from the pivot axis and an erect position extending upward from an upper end of the back; and means including an upper link having a rear end pivoted on the frame and a front end pivoted on the back; and a lower link having a rear end pivoted on the frame and a front end pivoted on the back for pivoting the headrest about the axis into the erect position on shifting of the back and seat into the relaxed position and for pivoting the headrest about the axis into the horizontal position on shifting of the back and seat into the sitting position.

8. A chair comprising:

a generally stationary frame;

a seat on the frame having a frame member;

a back on the frame;

means including a link pivoted on the frame member between a rear end of the seat and a lower end of the back for synchronous shifting of the seat and back between a sitting position with the back generally vertical and the seat generally horizontal and shifted rearward on the frame and a relaxed position with the back less vertical and the seat shifted forward on the frame;

a headrest on the frame above an upper end of the back;

a flexible cover over the headrest, back, and seat;

a pivot defining a horizontal pivot axis fixed at the upper end of the back and carrying the headrest for pivoting the headrest between a generally horizontal position extending rearward from the pivot axis and an erect position extending upward from an upper end of the back; and means including a linkage connected between the headrest and the back for pivoting the headrest about the axis into the erect position on shifting of the back and seat into the relaxed position and for pivoting the headrest about the axis into the horizontal position on shifting of the back and seat into the sitting position, the cover extending over a front face of the headrest and forming a part of the linkage, the cover tightening and pulling the headrest into the erect position on shifting of the back into relaxed position.

9. The chair defined in claim 8 wherein the linkage includes:

a main link having an upper end pivoted on the headrest at an axis parallel to but offset from the pivot axis and a lower end;

a lever centrally pivoted on the frame, having one end pivoted on the lower end of the main link and an opposite end; and means connecting the opposite end of the lever to the back.

10. The chair defined in claim 9 wherein the means connecting the opposite end to the back is a pivot, the opposite end being pivoted directly on the back.

11. The chair defined in claim 9 wherein the means connecting the opposite end to the back is a rigid secondary link having one end pivoted on the opposite end and another end pivoted on the back.

12. A chair comprising:

a generally stationary frame;

a seat on the frame having a frame member;

a back on the frame:

means including a link pivoted on the frame member between a rear end of the seat and a lower end of the back for synchronous shifting of the seat and back between a sitting position with the back generally vertical and the seat generally horizontal and shifted rearward on the frame and a relaxed position with the back less vertical and the seat shifted forward on the frame;

a headrest on the frame above an upper end of the back:

a flexible cover over the headrest, back, and seat;

a pivot defining a horizontal pivot axis fixed at the upper end of the back and carrying the headrest for pivoting the headrest between a generally horizontal position extending rearward from the pivot axis and an erect position extending upward from an upper end of the back; and means including a linkage connected between the headrest and the back for pivoting the headrest about the axis into the erect position on shifting of the back and seat into the relaxed position and for pivoting the headrest about the axis into the horizontal position on shifting of the back and seat into the sitting position, the frame having sides that cover and conceal the link and linkage in the sitting position.

13. A chair comprising:

a generally stationary frame;

a seat on the frame;

a back on the frame;

means including an upper link having a rear end pivoted on the frame and a front end pivoted on the back and a lower link having a rear end pivoted on the frame and a front end pivoted on the back for synchronous shifting of the seat and back between a sitting position with the back generally vertical and the seat generally horizontal and shifted rearward on the frame and a relaxed position with the back less vertical and the seat shifted forward on the frame;

a headrest on the frame above an upper end of the back;

a flexible cover over the headrest, back, and seat;

a pivot defining a horizontal pivot axis fixed at the upper end of the back and carrying the headrest for pivoting the headrest between a generally horizontal position extending rearward from the pivot axis and an erect position extending upward from an upper end of the back; and means including a linkage connected between the headrest and the back for pivoting the headrest about the axis into the erect position on shifting of the back and seat into the relaxed position and for pivoting the headrest about the axis into the horizontal position on shifting of the back and seat into the sitting position.

* * * * *